US007258507B2

(12) United States Patent
Kim et al.

(10) Patent No.: US 7,258,507 B2
(45) Date of Patent: Aug. 21, 2007

(54) ENVIRONMENT ORIENTED ROAD STUD

(76) Inventors: Dong-hwan Kim, Sejong Apt. #406, 100, Dangju-dong, Jongro-ku, 110-071 Seoul City (KR); Seung-hyun Yang, Samsung Apt. #116-1105, Shindang-4dong, Jung-ku, 100-763 Seoul City (KR); Hyung-ju Na, Woosung Apt. #108-601, 2525, Bangbae-2dong, Seocho-ku, 137-042 Seoul City (KR)

( * ) Notice: Subject to any disclaimer, the term of this patent is extended or adjusted under 35 U.S.C. 154(b) by 0 days.

(21) Appl. No.: 11/348,729

(22) Filed: Feb. 6, 2006

(65) Prior Publication Data

US 2006/0193692 A1 Aug. 31, 2006

(51) Int. Cl.
*E01F 11/00* (2006.01)

(52) U.S. Cl. ..... 404/15

(58) Field of Classification Search ..... 404/15, 404/16; 116/63 R

See application file for complete search history.

(56) References Cited

U.S. PATENT DOCUMENTS 1,798,467 A * 3/1931 Hartzler et al. ..... 404/15
1,804,281 A * 5/1931 Shunk ..... 404/15
1,816,502 A * 7/1931 Theel ..... 404/15
1,816,839 A 8/1931 George
1,870,994 A * 8/1932 George ..... 404/15
1,968,097 A 7/1934 Roberts
1,999,077 A * 4/1935 Benedetto ..... 219/152
2,015,031 A * 9/1935 Fischer ..... 404/15
D106,286 S * 10/1937 Dickson ..... D10/113
2,154,966 A * 4/1939 Vanderveer ..... 52/103
2,263,583 A * 11/1941 Limbert ..... 404/15
3,091,996 A 6/1963 Macrae
D246,513 S * 11/1977 Garneau ..... D10/66

* cited by examiner

*Primary Examiner*—Gary S. Hartmann
(74) *Attorney, Agent, or Firm*—Cantor Colburn LLP

(57) ABSTRACT

Disclosed is a road stud including an indicating part exposed on a road surface, an anchor extended from the indicating part and inserted into an anchor inserting hole of the road surface and at least one pair of anti-rotation wings interposed between the road surface and the indicating part, and intersecting with each other at an inclined angle to the bottom of the indicating part.

18 Claims, 5 Drawing Sheets

ENVIRONMENT ORIENTED ROAD STUD

CROSS-REFERENCE TO RELATED APPLICATIONS

This application claims the benefit of Korean Patent Application No. 2001-0047014, filed on Aug. 3, 2001, and Korean Patent Application No. 2001-0048064, filed on Aug. 9, 2001, in the Korean Intellectual Property Office, the disclosure of which is incorporated herein by reference.

BACKGROUND OF THE INVENTION

1. Field of the Invention

The present invention relates to a road stud, and more particularly, to a road stud which is prevented from randomly rotating even though an external force is applied thereto in any directions.

2. Description of the Related Art

A road stud is generally installed along a central line of a pavement at regular intervals so as to allow a driver to effectively recognize the central line of the pavement.

The road stud includes an indicating part provided with a reflector reflecting light, and an anchor extended from the bottom of the indicating part and embedded in a road surface.

To install the road stud, first a position where the road stud is studded is determined and a hole (hereinafter, referred to as an "anchor inserting hole") is dug. Then, glue is poured into the anchor inserting hole. The anchor of the road stud is inserted into the anchor inserting hole, and then vibration is given to the road stud. Thereafter, the road stud is stayed as it is until the glue is dried up completely, and then the glue exposed to the road surface is removed, thereby finishing the installation of the road stud.

However, because the installation of the conventional road stud depends on only adhesive strength of the glue, the indicating part may be rotated on the road surface when a quake arises or a car treads thereon. Further, as the road stud is likely to randomly rotate with respect to the anchor inserting hole as it is frequently shocked.

To prevent the foregoing problems, U.S. Pat. No. 1,968,097 discloses a road stud that has projections placed in an undersurface of a head part and a bottom part thereof. However, the projection is not enough to prevent the road stud from randomly rotating by an external force.

In particular, the projection protrudes just downward without any direction, so that the road stud is easily rotated when the external force is applied to the head part in a clockwise direction or a counter clockwise direction.

SUMMARY OF THE INVENTION

Accordingly, it is an aspect of the present invention to provide a road stud which is prevented from randomly rotating even though an external force is applied thereto in any directions.

The foregoing and/or other aspects of the present invention can be achieved by providing a road stud comprising: an indicating part exposed on a road surface; an anchor extended from the indicating part and inserted into an anchor inserting hole of the road surface; and at least one pair of anti-rotation wings provided in the indicating part, interposed between the road surface and the indicating part, and intersecting with each other at an inclined angle to the bottom of the indicating part.

According to an aspect of the present invention, the road stud further comprises a coupling plate formed with a coupling hole through which the anchor is inserted, and coupled to the bottom of the indicating part, wherein the at least one pair of anti-rotation wings is provided in the coupling plate.

According to an aspect of the present invention, the at least one pair of anti-rotation wings is resilient.

According to an aspect of the present invention, the anchor comprises a rotatable anchor rotatably inserted through a through hole formed in the indicating part, and formed with a male thread.

According to an aspect of the present invention, the road stud further comprises: a breakaway preventing part that is liftaby coupled to the rotatable anchor, and comprises a plurality of upper spread wings radially spread out and inclined upwardly with respect to an axis line of the rotatable anchor, and a plurality of lower spread wings placed below the plurality of upper spread wings, radially spread out and inclined downwardly with respect to the axis line of the rotatable anchor; an upper spreader placed above the breakaway preventing part and spreading out the upper spread wings when the breakaway preventing part moves up; and an upper presser formed with a female thread to be engaged with the male thread of the rotatable anchor, placed under the breakaway preventing part, moving up to press the breakaway preventing part upwardly and at the same time to spread out the plurality of lower spread wings as the rotatable anchor is rotated in a predetermined direction.

According to an aspect of the present invention, the anchor comprises a stationary anchor downwardly extended integrally from the indicating part along the axis line of the rotatable anchor, and having an accommodating hole aligned with the through hole to accommodate the rotatable anchor inserted through the through hole, and the stationary anchor comprises a lower pat employed as the upper spreader for spreading out the plurality of upper spread wings.

According to an aspect of the present invention, the breakaway preventing part comprises a slider connecting the plurality of upper spread wings and the plurality of lower spread wings, and formed with an inserting hole on a surface thereof through which the rotatable anchor passes.

According to an aspect of the present invention, the plurality of upper and lower spread wings each comprises an anti-rotation projection placed at an end thereof and protruding in a direction transverse to a surface thereof.

According to an aspect of the present invention, the plurality of upper and lower spread wings each comprises an anti-rotation projection placed at an end thereof and protruding in a direction transverse to a surface thereof.

According to an aspect of the present invention, the plurality of upper and lower spread wings each comprises an anti-rotation projection placed at an end thereof and protruding in a direction transverse to a surface thereof.

According to an aspect of the present invention, the anchor comprises a rotatable anchor rotatably inserted through a through hole formed in the indicating part, and formed with a male thread.

According to an aspect of the present invention, the road stud further comprises: a breakaway preventing part that is liftaby coupled to the rotatable anchor, and comprises a plurality of upper spread wings radially spread out and inclined upwardly with respect to an axis line of the rotatable anchor, and a plurality of lower spread wings placed below the plurality of upper spread wings, radially spread out and inclined downwardly with respect to the axis line of the rotatable anchor; an upper spreader placed above the breakaway preventing part and spreading out the upper spread wings when the breakaway preventing part moves up; and an upper presser formed with a female thread to be engaged with the male thread of the rotatable anchor, placed under the breakaway preventing part, moving up to press the breakaway preventing part upwardly and at the same time to spread out the plurality of lower spread wings as the rotatable anchor is rotated in a predetermined direction.

According to an aspect of the present invention, the anchor comprises a stationary anchor downwardly extended integrally from the indicating part along the axis line of the rotatable anchor, and having an accommodating hole aligned with the through hole to accommodate the rotatable anchor inserted through the through hole, and the stationary anchor comprises a lower pat employed as the upper spreader for spreading out the plurality of upper spread wings.

According to an aspect of the present invention, the breakaway preventing part comprises a slider connecting the plurality of upper spread wings and the plurality of lower spread wings, and formed with an inserting hole on a surface thereof through which the rotatable anchor passes.

According to an aspect of the present invention, the plurality of upper and lower spread wings each comprises an anti-rotation projection placed at an end thereof and protruding in a direction transverse to a surface thereof.

According to an aspect of the present invention, the plurality of upper and lower spread wings each comprises an anti-rotation projection placed at an end thereof and protruding in a direction transverse to a surface thereof.

According to an aspect of the present invention, the plurality of upper and lower spread wings each comprises an anti-rotation projection placed at an end thereof and protruding in a direction transverse to a surface thereof.

BRIEF DESCRIPTION OF THE DRAWINGS

The above and/or other aspects and advantages of the present invention will become apparent and more readily appreciated from the following description of the embodiments, taken in conjunction with the accompany drawings of which.

DETAILED DESCRIPTION OF EMBODIMENTS

Hereinafter, embodiments of the present invention will be described with reference to accompanying drawings.

Figure 1:
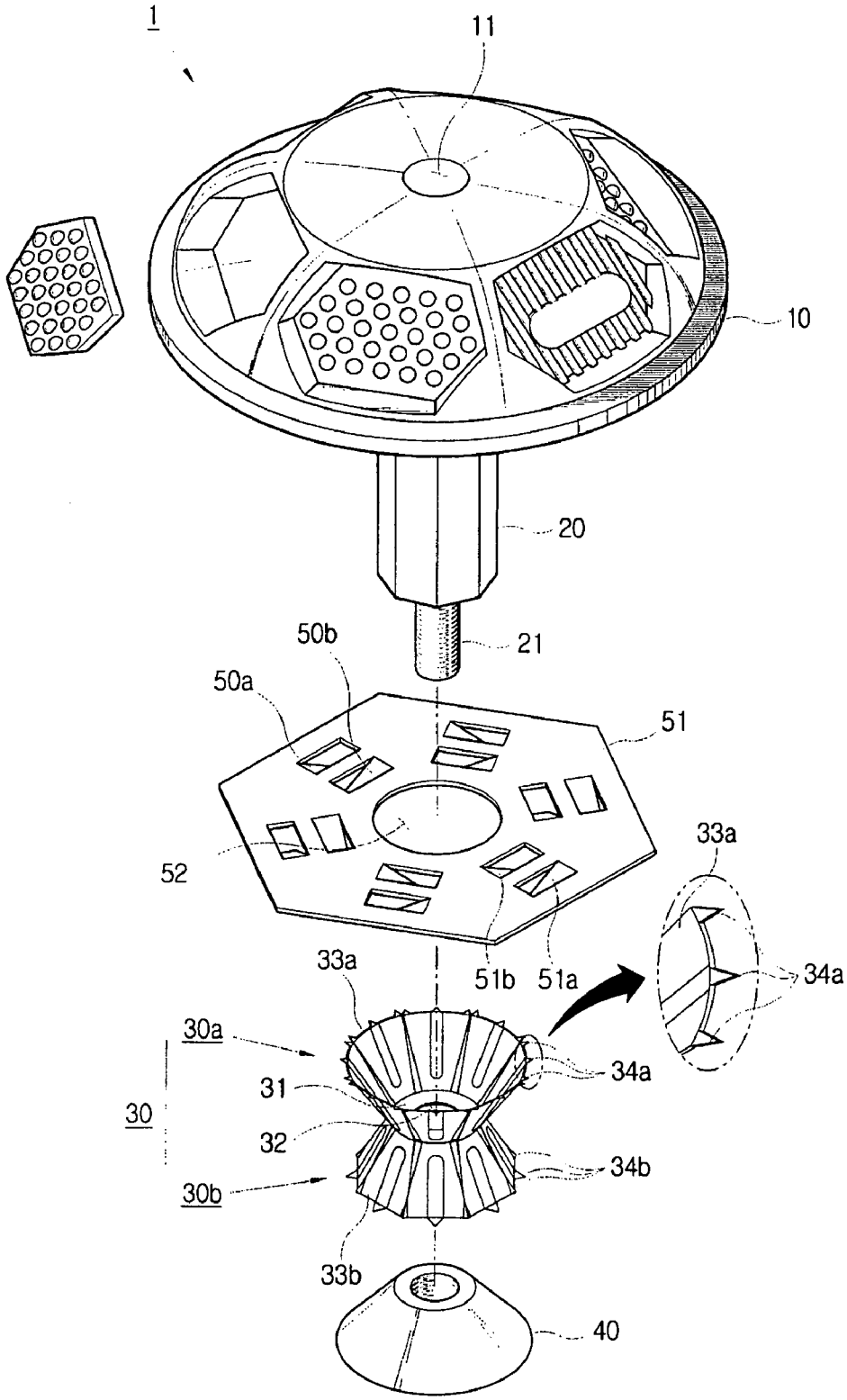
FIG. 1 is an exploded perspective view of a road stud according to an embodiment of the present invention.
Figure 2:
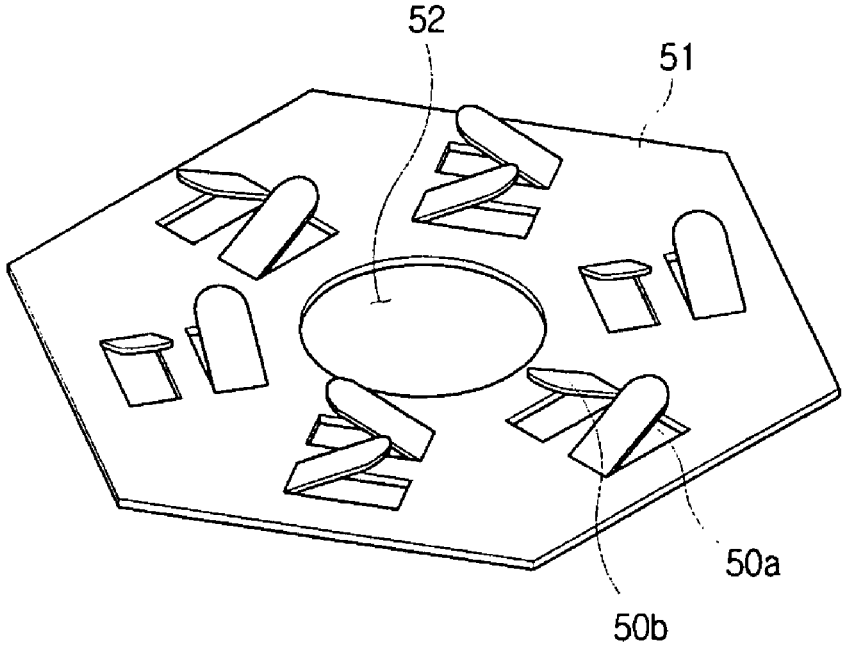
FIG. 2 is an enlarged perspective view of an anti-rotation wing provided in an indicating part of FIG. 1.
Figure 3:
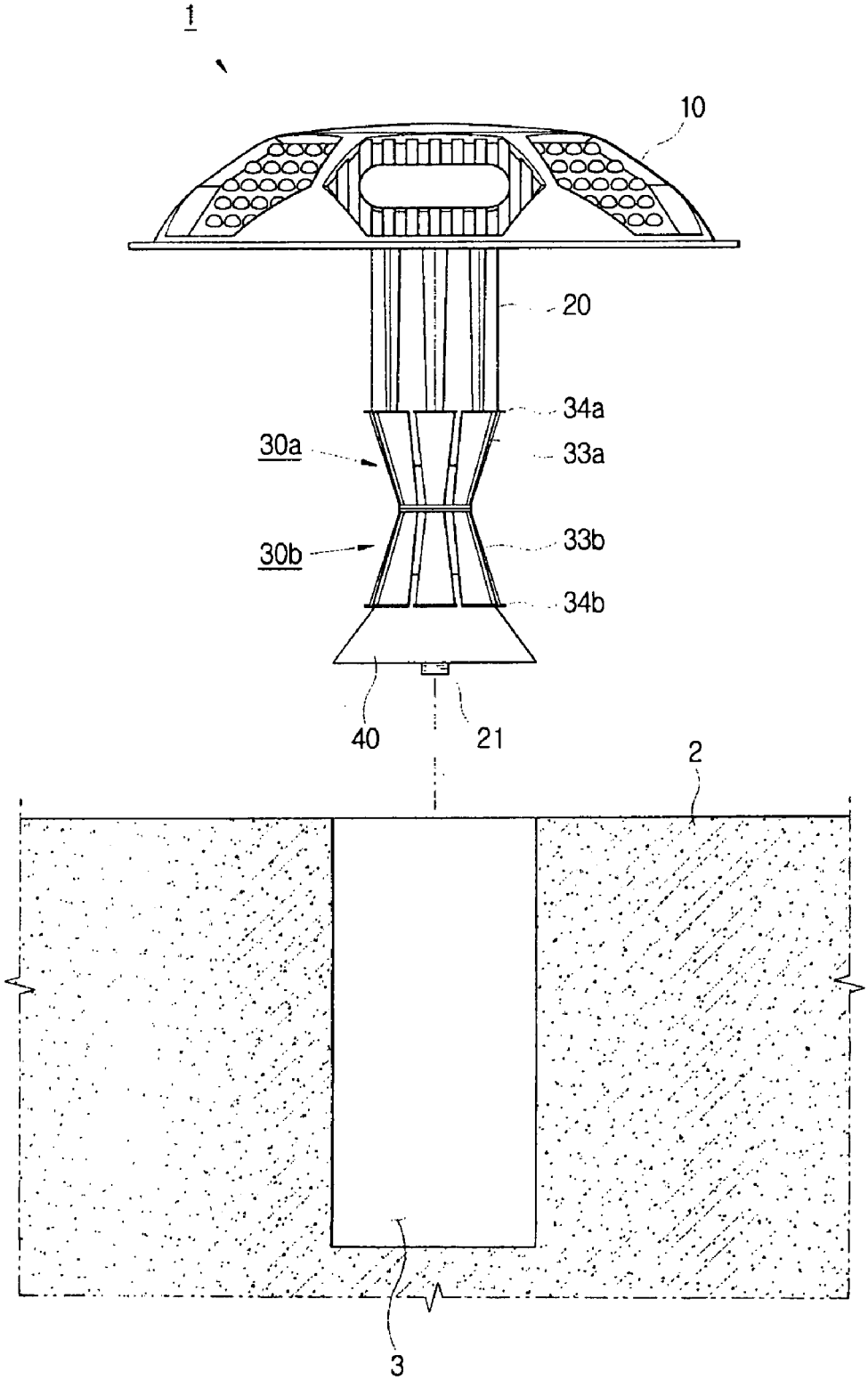
FIG. 3 is an assembled perspective view of the road stud according to an embodiment of the present invention.
Figure 4:
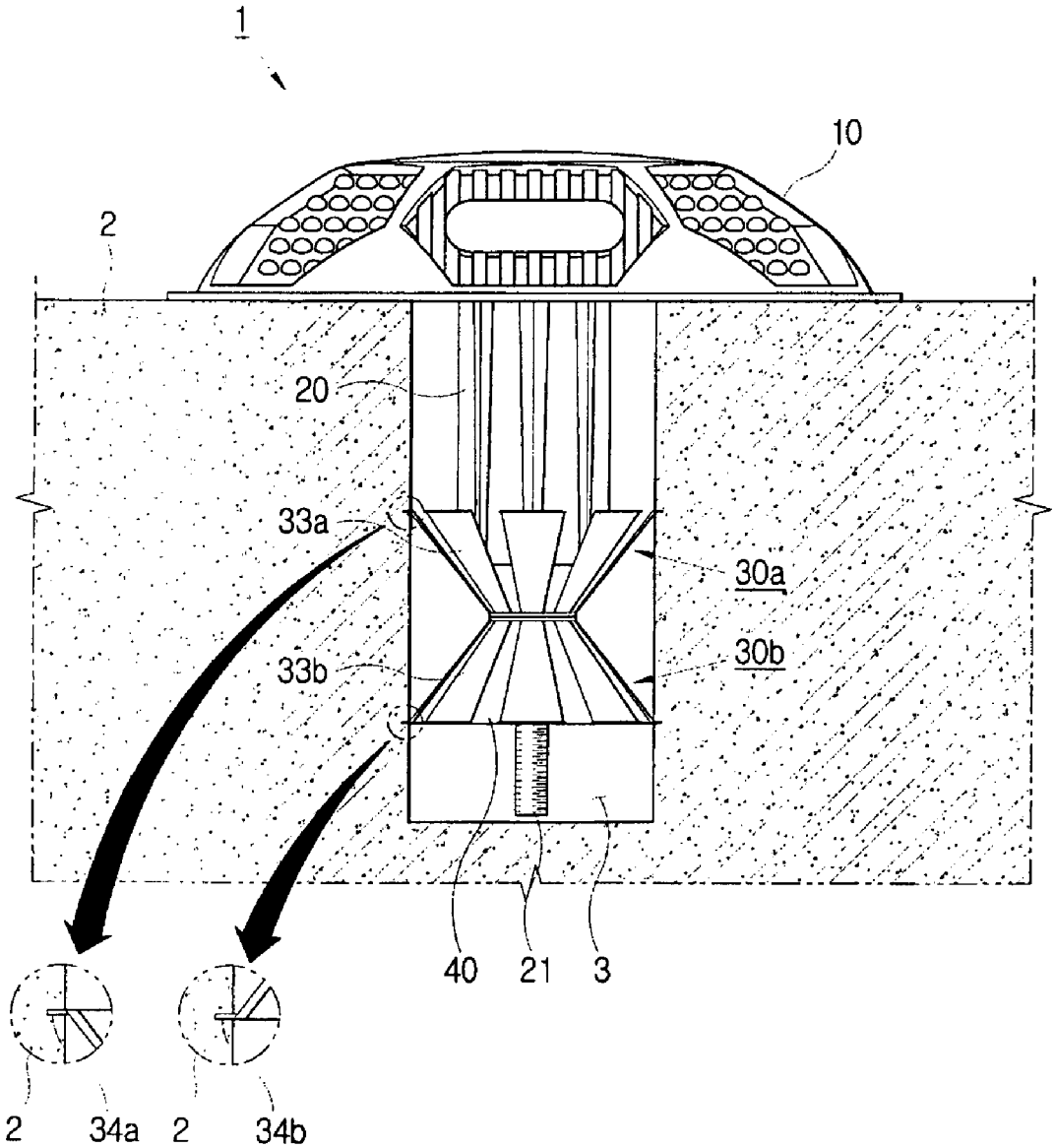
FIG. 4 illustrates an installed state of the road stud according to an embodiment of the present invention.
Figure 5:
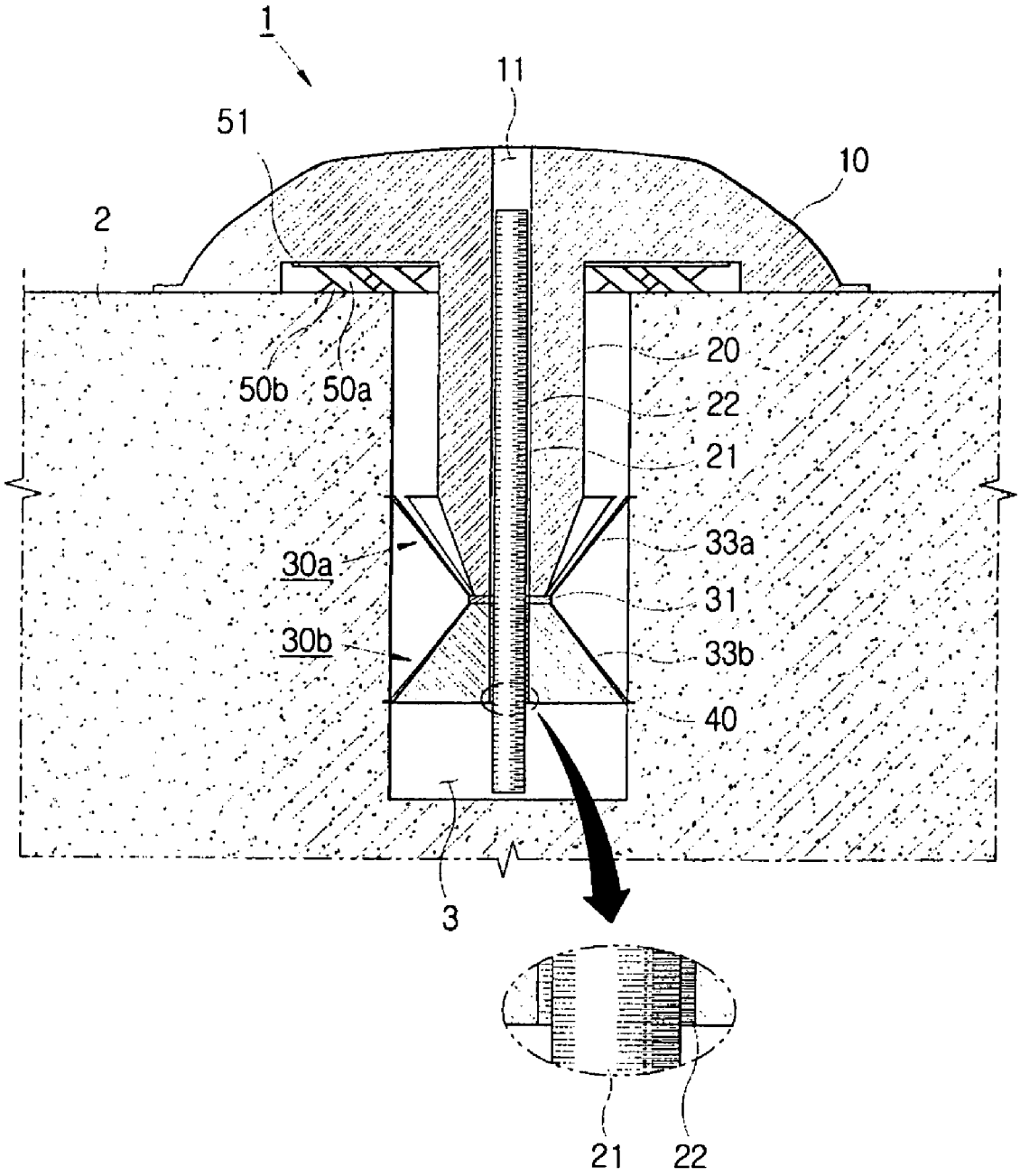
FIG. 5 is a sectional view of FIG. 4.

FIG. 1 is an exploded perspective view of a road stud according to an embodiment of the present invention, FIG. 2 is an enlarged perspective view of an anti-rotation wing provided in an indicating part of FIG. 1, FIG. 3 is an assembled perspective view of the road stud according to an embodiment of the present invention, FIG. 4 illustrates an installed state of the road stud according to an embodiment of the present invention, and FIG. 5 is a sectional view of FIG. 4.

As shown in FIGS. 1 and 2, a road stud 1 according to an embodiment of the present invention includes an indicating part 10 exposed on a road surface 2 and formed with a through hole 11; anti-rotation wings 50*a* and 50*b* placed under the indicating part 10; an anchor 20, 21 having an rotatable anchor 21 rotatably inserted through the through hole 11, and an stationary anchor 20 placed under the indicating part 10 and accommodating the rotatable anchor 21; a breakaway preventing part 30 liftably coupled to the rotatable anchor 21; and an upward presser 40 placed under the breakaway preventing part 30.

The indicating part 10 is exposed onto the road surface 2. The indicating part 10 includes a design carving part in which a design for publicity is carved, and a reflector formed along the circumference thereof and creating scattered reflection.

"As shown in FIG. 2, the indicating part 10 includes a plurality of pairs of anti-rotation wings 50*a* and 50*b*. Each pair of anti-rotation wings includes at least a first anti-rotation wing, e.g., 50*a* and a second anti-rotation wing, e.g., 50*b*. The first anti-rotation wing is disposed at a first angle with respect to the bottom of the indicating part 10. The second anti-rotation wing is disposed substantially adjacent to and extending in a direction opposite to the first anti-rotation wing and at a second angle with respect to the bottom of the indicating part 10."

The pairs of anti-rotation wings 50*a* and 50*b* are provided on a coupling plate 51 formed with a coupling hole 52 through which the stationary anchor 20 is inserted. The coupling plate 51 is coupled to the bottom of the indicating part 10. Here, the anti-rotation wings 50*a* and 50*b* are formed on the coupling plate 51 provided separately from the indicating part 10, but not limited thereto. Alternatively, the anti-rotation wings 50*a* and 50*b* may be integrally formed on the bottom of the indicating part 10.

The pairs of anti-rotation wings 50*a* and 50*b* are made of a predetermined resilient material and interposed between the bottom of the indicating part 10 and the road surface 2.

The pairs of anti-rotation wings 50*a* and 50*b* penetrate the road surface 2 when an external force is applied to the indicating part 10, thereby preventing the road stud 1 from rotating.

"That is, because the pair of anti-rotation wings 50*a* an 50*b* are disposed adjacent and opposite each other at an atypical angle, the road stud 1 is prevented from rotating even though the external force is applied to the indicating part 10 in a clockwise direction or a counterclockwise direction."

The indicating part 10 is formed with the through hole 11 along an axis line of the rotatable anchor 21, so that the rotatable anchor 21 is rotatably inserted through the through hole 11.

The stationary anchor 20 is embedded in an anchor inserting hole 3. Here, the stationary anchor 20 can be integrally extended downward from the indicating part 10 along the axis line of the rotatable anchor 21. Alternatively, the stationary anchor 20 can be provided separately from the indicating part 10 and coupled to the indicating part 10 by welding or a screw.

Further, the stationary anchor 20 includes an accommodating hole 22 aligned with the through hole 11 so as to accommodate the rotatable anchor 21 inserted through the through hole 11 of the indicating part 10. Thus, the rotatable anchor 21 is inserted in the accommodating hole 22 via the through hole 11 and its lower part is exposed below the stationary anchor 20.

The lower part of the stationary anchor 20 is placed above a plurality of upper spread wings 33*a* of the breakaway preventing part 30, and used as an upper spreader for spreading out the plurality of upper spread wings 33*a* when the breakaway preventing part 30 moves up.

The rotatable anchor 21 is externally formed with a male thread. The rotatable anchor 21 is inserted in the accommodating part 22 of the stationary anchor 20 via the through hole 11 of the indicating part 10. At this time, the lower part of the rotatable anchor 21 is exposed beyond that of the stationary anchor 20. As shown in FIG. 5, the rotatable anchor 21 is formed with the male thread throughout its body part, but not limited thereto. Alternatively, the rotatable anchor 21 may be partially formed with the male thread in only the lower part thereof exposed beyond the stationary anchor 20.

The breakaway preventing part 30 includes a slider 31 formed with an inserting hole 32 for the rotatable anchor 21, an upper breakaway preventing part 30*a* placed above the slider 31, and a lower breakaway preventing part 30*b* provided below the slider 31.

Under the lower breakaway preventing part 30*b* is provided the upper presser 40 to be coupled with the lower part of the rotatable anchor 21 passed through the inserting hole 32. Here, the upper presser 40 is internally formed with a female thread to be engaged with the male thread formed on the rotatable anchor 21. Thus, the upper presser 40 moves up as the rotatable anchor 21 rotates in a predetermined direction, thereby pressing the breakaway preventing part 30 upwardly and at the same time spreading out a plurality of lower spread wings 33*b*.

The slider 31 is formed with the inserting hole 32 having an approximately same shape as the section of the rotatable anchor 21 and through which the rotatable anchor 21 is inserted. For example, the inserting hole 32 has a circular shape or a polygonal shape. Further, cutting lines may be radially formed along the edge of the inserting hole 32.

The upper breakaway preventing part 30*a* is extended upwardly from the slider 31 and includes the plurality of upper spread wings 33*a* placed along the circumference of the stationary anchor 20. Each end of the upper spread wings 33*a* includes a plurality of upper anti-rotation projections 34*a*.

The plurality of upper spread wings 33*a* is radially spread out and upwardly inclined with respect to the axis line of the rotatable anchor 21. When the breakaway preventing part 30 moves up by rotating the rotatable anchor 21 in a predetermined direction, the lower part of the stationary anchor 20 makes the plurality of upper spread wings 33*a* be spread out radially with respect to the axis line of the rotatable anchor 21 and supported on an inner wall of the anchor inserting hole 3 (referring to FIGS. 4 and 5).

The plurality of upper anti-rotation projections 34*a* is provided in the end of each upper spread wing 33*a* and supported on the inner wall of the anchor inserting hole 3. Here, the upper anti-rotation projection 34*a* is bent from the surface of each upper spread wing 33*a*. Alternatively, the upper anti-rotation projection 34*a* may be provided separately from and coupled to the upper spread wing 33*a*.

The plurality of lower spread wings 33*b* is radially spread out and downwardly inclined with respect to the axis line of the rotatable anchor 21. When the rotatable anchor 21 is rotated in a predetermined direction, the upper presser 40 presses the breakaway preventing part 30 upwardly and at the same time makes the plurality of lower spread wings 33*b* be spread out radially with respect to the axis line of the rotatable anchor 21 and supported on the inner wall of the anchor inserting hole 3 (referring to FIGS. 4 and 5).

The plurality of lower anti-rotation projections 34*b* is provided in the end of each lower spread wing 33*b* and supported on the inner wall of the anchor inserting hole 3. Here, the lower anti-rotation projection 34*b* is bent from the surface of each lower spread wing 33*b*. Alternatively, the lower anti-rotation projection 34*b* may be provided separately from and coupled to the lower spread wing 33*b*.

In the road stud 1 with this configuration, a process of coupling the breakaway preventing part 30 to the rotatable anchor 21 and installing it on the road surface 2 will be described below.

First, to couple the breakaway preventing part 30 to the lower part of the stationary anchor 20, the lower part of the rotatable anchor 21 placed beyond the stationary anchor 20 is inserted in the inserting hole 32 of the breakaway preventing hole 30. Then, the upper presser 40 is coupled to the lower part of the rotatable anchor 21 inserted in the inserting hole 32 of the breakaway preventing part 30. At this time, as shown in FIG. 3, the upper presser 40 is coupled to the lower part of the rotatable anchor 21 and accommodated in an accommodating space formed by the plurality of lower spread wings 33*b*.

As shown in FIG. 3, after the breakaway preventing part 30 is completely coupled to the lower part of the stationary anchor 20, a position where the road stud 1 is installed is determined, and the anchor inserting hole 3 is dug at the determined position.

"Thereafter, the stationary anchor 20 is inserted in the anchor inserting hole 3. At this time, the pair of anti-rotation wings 50*a* and 50*b* is interposed between the bottom of the indicating part 10 and the road surface 2. If the coupling plate 51 were to be viewed from an edge on perspective, the pair of anti-rotation wings 50*a* and 50*b* would appear to form an 'X' like shape due to their inclination with respect to the bottom of the indicating part 10 and their adjacent and opposite disposition."

Then, the rotatable anchor 21 is rotated through the through hole 11 in a fastening direction. At this time, the breakaway preventing part 30 moves up along with the upper presser 40 while the male thread of the rotatable anchor 21 and the female thread of the upper presser 40 are engaged with each other.

While moving up, the plurality of upper spread wings 33*a* of the breakaway preventing part 30 contacts the lower part of the stationary anchor 20. In this state, the rotatable anchor 21 is further rotated in the fastening direction, and thus the upper presser 40 presses the breakaway preventing part 30 upwardly from the bottom of the breakaway preventing part 30.

As shown in FIGS. 4 and 5, the upper spread wings 33*a* is pressed by the lower part of the stationary anchor 20, and the lower spread wings 33*b* is pushed by the upper presser 40, so that the upper and lower spread wings 33*a* and 33*b* spread out radially. At this time, the upper anti-rotation projection 34*a* and the lower anti-rotation projection 34*b* penetrate the inner wall of the anchor inserting hole 3 and are supported on the inner wall.

"Thus, according to the present invention, the plural pairs of anti-rotation wings 50*a* and 50*b* are interposed between the bottom of the indicating part 10 and the road surface 2, so that the road stud 1 is prevented from rotating even though an external force is applied thereto in the clockwise direction or the counterclockwise direction."

Further, the upper and lower anti-rotation projections 34*a* and 34*b* are employed for supporting the road stud 1 to do not rotating in the anchor inserting hole 3 even though predetermined torque is applied to the road stud 1.

Also, the upper and lower spread wings 33*a* and 33*b* are spread out and supported on the inner wall of the anchor inserting hole 3, so that the road stud 1 is firmly installed in the anchor inserting hole 3 of the road surface 2 and prevented from a breakaway due to the external force.

In the foregoing embodiment, the upper and lower spread wings 33*a* and 33*b* are integrally formed as a single body in the upper and lower sides of the slider 31 having the inserting hole 32, respectively. Alternatively, the upper and lower spread wings may be provided separately from each other. That is, the breakaway preventing part may include an upper breakaway preventing part having an upper slider and an upper spread wing extended upwardly from the upper slider; and a lower breakaway preventing part having a lower slider and a lower spread wing extended downwardly from the lower slider.

Further, in the foregoing embodiment, the upper and lower spread wings 33*a* and 33*b* have the same length, but not limited thereto. Alternatively, the plurality of upper spread wings may have various lengths. Likewise, the plurality of lower spread wings may have various lengths.

As described above, the present invention provides a road stud which can be prevented from randomly rotating even though an external force is applied thereto in any directions. Further, the road stud includes a breakaway preventing part formed with a plurality of upper and lower spread wings, so that the road stud is firmly installed in a road surface, thereby being prevented from randomly rotating due to the external force.

Although a few embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. A road stud comprising:

an indicating part exposed on a road surface;

an anchor extended from the indicating part and inserted into an anchor inserting hole of the road surface; and at least one pair of anti-rotation wings including at least a first anti-rotation wing and a second anti-rotation wing interposed between the road surface and the indicating part, wherein the first anti-rotation wing is disposed at a first angle with respect to the bottom of the indicating part and the second anti-rotation wing is disposed substantially adjacent and opposite the first wing and at a second angle with respect to the bottom of the indicating part.

2. The road stud according to claim 1, further comprising a coupling plate formed with a coupling hole through which the anchor is inserted, and coupled to the bottom of the indicating part, wherein the at least one pair of anti-rotation wings is provided in the coupling plate.

3. The road stud according to claim 2, wherein the at least one pair of anti-rotation wings is resilient.

4. The road stud according to claim 3, wherein the anchor comprises a rotatable anchor rotatably inserted through a through hole formed in the indicating part, and formed with a male thread.

5. The road stud according to claim 4, further comprising:

a breakaway preventing part that is liftably coupled to the rotatable anchor, and comprises a plurality of upper spread wings radially spread out and inclined upwardly with respect to an axis line of the rotatable anchor, and a plurality of lower spread wings placed below the plurality of upper spread wings, radially spread out and inclined downwardly with respect to the axis line of the rotatable anchor;

an upper spreader placed above the breakaway preventing part and spreading out the upper spread wings when the breakaway preventing part moves up; and an upper presser formed with a female thread to be engaged with the male thread of the rotatable anchor, placed under the breakaway preventing part, moving up to press the breakaway preventing part upwardly and at the same time to spread out the plurality of lower spread wings as the rotatable anchor is rotated in a predetermined direction.

6. The road stud according to claim 5, wherein the anchor comprises a stationary anchor downwardly extended integrally from the indicating part along the axis line of the rotatable anchor, and having an accommodating hole aligned with the through hole to accommodate the rotatable anchor inserted through the through hole, and the stationary anchor comprises a lower part employed as the upper spreader for spreading out the plurality of upper spread wings.

7. The road stud according to claim 6, wherein the breakaway preventing part comprises a slider connecting the plurality of upper spread wings and the plurality of lower spread wings, and formed with an inserting hole on a surface thereof through which the rotatable anchor passes.

8. The road stud according to claim 7, wherein the plurality of upper and lower spread wings each comprises an anti-rotation projection placed at an end thereof and protruding in a direction transverse to a surface thereof.

9. The road stud according to claim 6, wherein the plurality of upper and lower spread wings each comprises an anti-rotation projection placed at an end thereof and protruding in a direction transverse to a surface thereof.

10. The road stud according to claim 5, wherein the plurality of upper and lower spread wings each comprises an anti-rotation projection placed at an end thereof and protruding in a direction transverse to a surface thereof.

11. The road stud according to claim 1, wherein the anchor comprises a rotatable anchor rotatably inserted through a through hole formed in the indicating part, and formed with a male thread.

12. The road stud according to claim 11, further comprising:

a breakaway preventing part that is liftably coupled to the rotatable anchor, and comprises a plurality of upper spread wings radially spread out and inclined upwardly with respect to an axis line of the rotatable anchor, and a plurality of lower spread wings placed below the plurality of upper spread wings, radially spread out and inclined downwardly with respect to the axis line of the rotatable anchor;

an upper spreader placed above the breakaway preventing part and spreading out the upper spread wings when the breakaway preventing part moves up; and an upper presser formed with a female thread to be engaged with the male thread of the rotatable anchor, placed under the breakaway preventing part, moving up to press the breakaway preventing part upwardly and at the same time to spread out the plurality of lower spread wings as the rotatable anchor is rotated in a predetermined direction.

13. The road stud according to claim 12, wherein the anchor comprises a stationary anchor downwardly extended integrally from the indicating part along the axis line of the rotatable anchor, and having an accommodating hole aligned with the through hole to accommodate the rotatable anchor inserted through the through hole, and the stationary anchor comprises a lower part employed as the upper spreader for spreading out the plurality of upper spread wings.

14. The road stud according to claim 13, wherein the breakaway preventing part comprises a slider connecting the plurality of upper spread wings and the plurality of lower spread wings, and formed with an inserting hole on a surface thereof through which the rotatable anchor passes.

15. The road stud according to claim 14, wherein the plurality of upper and lower spread wings each comprises an anti-rotation projection placed at an end thereof and protruding in a direction transverse to a surface thereof.

16. The road stud according to claim 13, wherein the plurality of upper and lower spread wings each comprises an anti-rotation projection placed at an end thereof and protruding in a direction transverse to a surface thereof.

17. The road stud according to claim 12, wherein the plurality of upper and lower spread wings each comprises an anti-rotation projection placed at an end thereof and protruding in a direction transverse to a surface thereof.

18. The road stud according to claim 1, wherein the first and second angles are substantially similar.

* * * * *